US006328533B1

(12) United States Patent
Decker et al.

(10) Patent No.: US 6,328,533 B1
(45) Date of Patent: Dec. 11, 2001

(54) SWEPT BARREL AIRFOIL

(75) Inventors: John J. Decker, Liberty Township; Andrew Breeze-Stringfellow, Montgomery; Gregory T. Steinmetz, Cincinnati; Peter N. Szucs, West Chester, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/467,956

(22) Filed: Dec. 21, 1999

(51) Int. Cl.[7] ..... F01D 5/14
(52) U.S. Cl. ..... 416/228; 416/223 A; 416/242
(58) Field of Search ..... 416/228, 238, 416/242, 243, 223 A

(56) References Cited

U.S. PATENT DOCUMENTS 1,806,345 * 5/1931 Halvorsen ..... 416/242
2,104,306 * 1/1938 McLeod ..... 416/243
4,726,737 2/1988 Weingold et al. .
5,088,892 2/1992 Weingold et al. .
5,167,489 12/1992 Wadia et al. .
5,342,170 8/1994 Elvekjaer et al. .
5,642,985 7/1997 Spear et al. .
5,735,673 4/1998 Matheny et al. .
6,071,077 * 6/2000 Rowlands ..... 416/223 A

FOREIGN PATENT DOCUMENTS

0801230 A2 10/1997 (EP) .

* cited by examiner

*Primary Examiner*—Edward K. Look
*Assistant Examiner*—Ninh Nguyen
(74) *Attorney, Agent, or Firm*—Andrew C. Hess; Nathan D. Herkamp

(57) ABSTRACT

An airfoil includes a leading edge chord barrel between a root and a tip, and forward aerodynamic sweep at the tip.

20 Claims, 3 Drawing Sheets

SWEPT BARREL AIRFOIL

BACKGROUND OF THE INVENTION

The present invention relates generally to gas turbine engines, and, more specifically, to fans and compressors thereof.

A turbofan gas turbine engine includes a fan followed in turn by a multi-stage axial compressor each including a row of circumferentially spaced apart rotor blades, typically cooperating with stator vanes. The blades operate at rotational speeds which can result in subsonic through supersonic flow of the air, with corresponding shock therefrom. Shock introduces pressure losses and generates undesirable noise during operation.

In U.S. Pat. No. 5,167,489—Wadia et al, a forward swept rotor blade is disclosed for reducing aerodynamic losses during operation including those due to shock-boundary layer air interaction at blade tips.

However, fan and compressor airfoil design typically requires many compromises for aerodynamic, mechanical, and aero-mechanical reasons. An engine operates over various rotational speeds and the airfoils must be designed for maximizing pumping of the airflow therethrough while also maximizing compression efficiency. Rotational speed of the airfoils affects their design and the desirable flow pumping and compression efficiency thereof.

At high rotational speed, the flow Mach numbers relative to the airfoils are at their highest value, and the shock and boundary layer interaction is the most severe. Mechanical airfoil constraints are also severe at high rotor speed in which vibration and centrifugal stress have significant affect. And, aero-mechanical constraints, including flow flutter, must also be accommodated.

Accordingly, the prior art includes many fan and compressor blade configurations which vary in aerodynamic sweep, stacking distributions, twist, chord distributions, and design philosophies which attempt to improve rotor efficiency. Some designs have good rotor flow capacity or pumping at maximum speed with corresponding efficiency, and other designs effect improved part-speed efficiency at cruise operation, for example, with correspondingly lower flow pumping or capacity at maximum speed.

Accordingly, it is desired to provide an improved fan or compressor airfoil having both improved efficiency at part-speed, such as cruise operation, with high flow pumping or capacity at high speed, along with good operability margins for stall and flutter.

BRIEF SUMMARY OF THE INVENTION

An airfoil includes a leading edge chord barrel between a root and a tip, and forward aerodynamic sweep at the tip.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
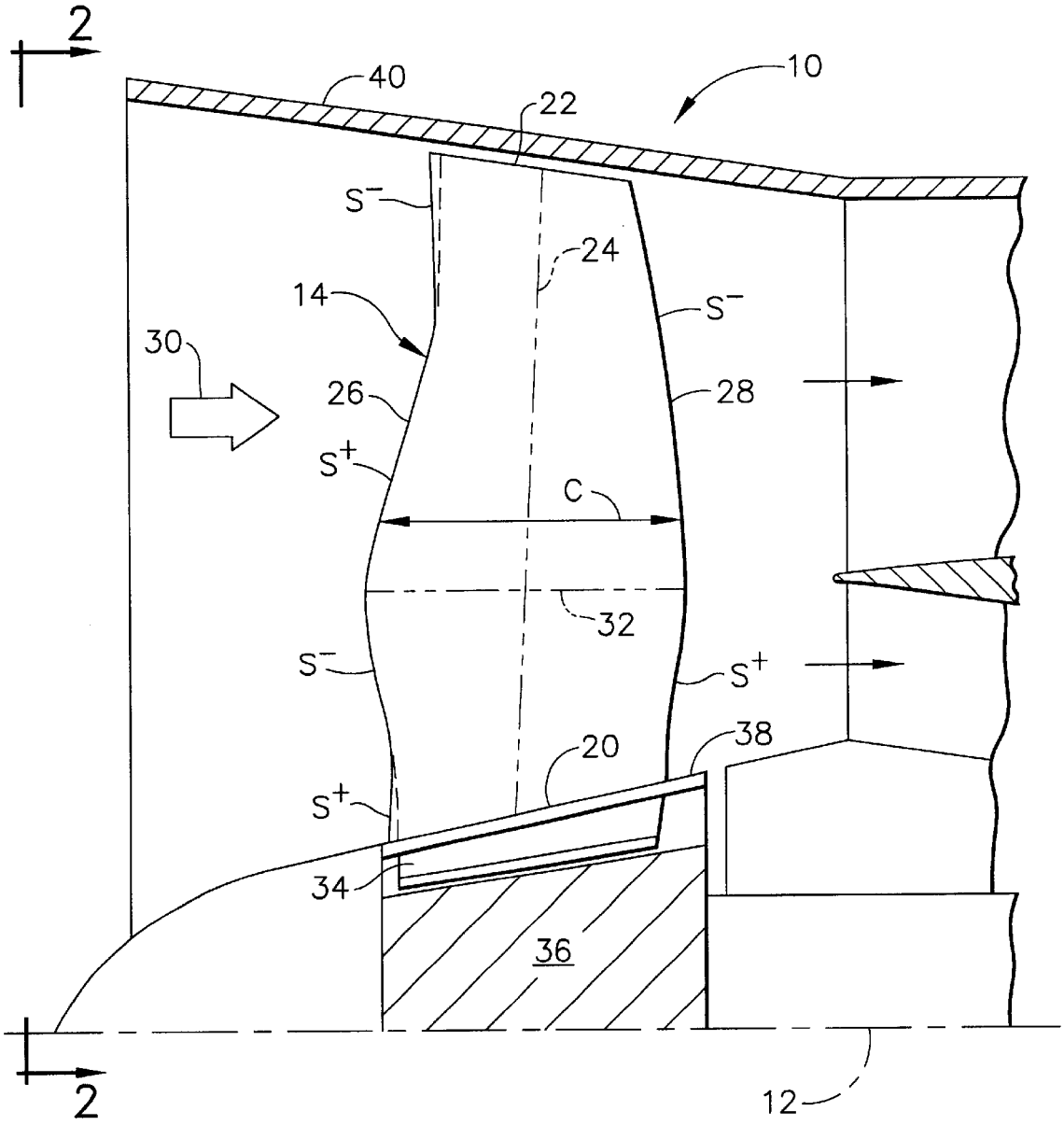
FIG. 1 is an axial, side elevational projection view of a row of fan blades in accordance with an exemplary embodiment of the present invention.

Illustrated in FIG. 1 is a fan 10 of an exemplary turbofan gas turbine engine shown in part. The fan 10 is axisymmetrical about an axial centerline axis 12.

Figure 2:
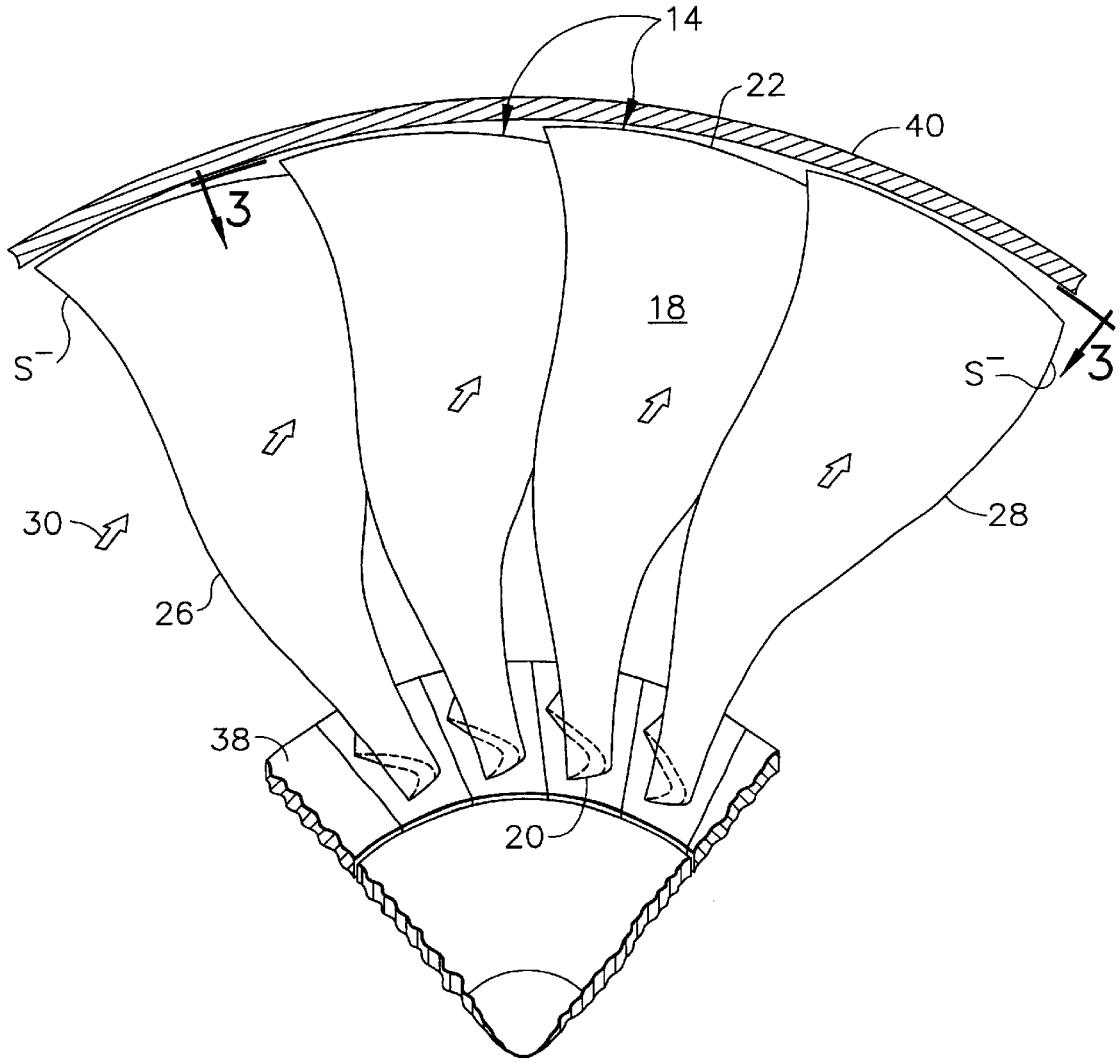
FIG. 2 is a forward-looking-aft radial view of a portion of the fan illustrated in FIG. 1 and taken along line 2—2.
Figure 3:
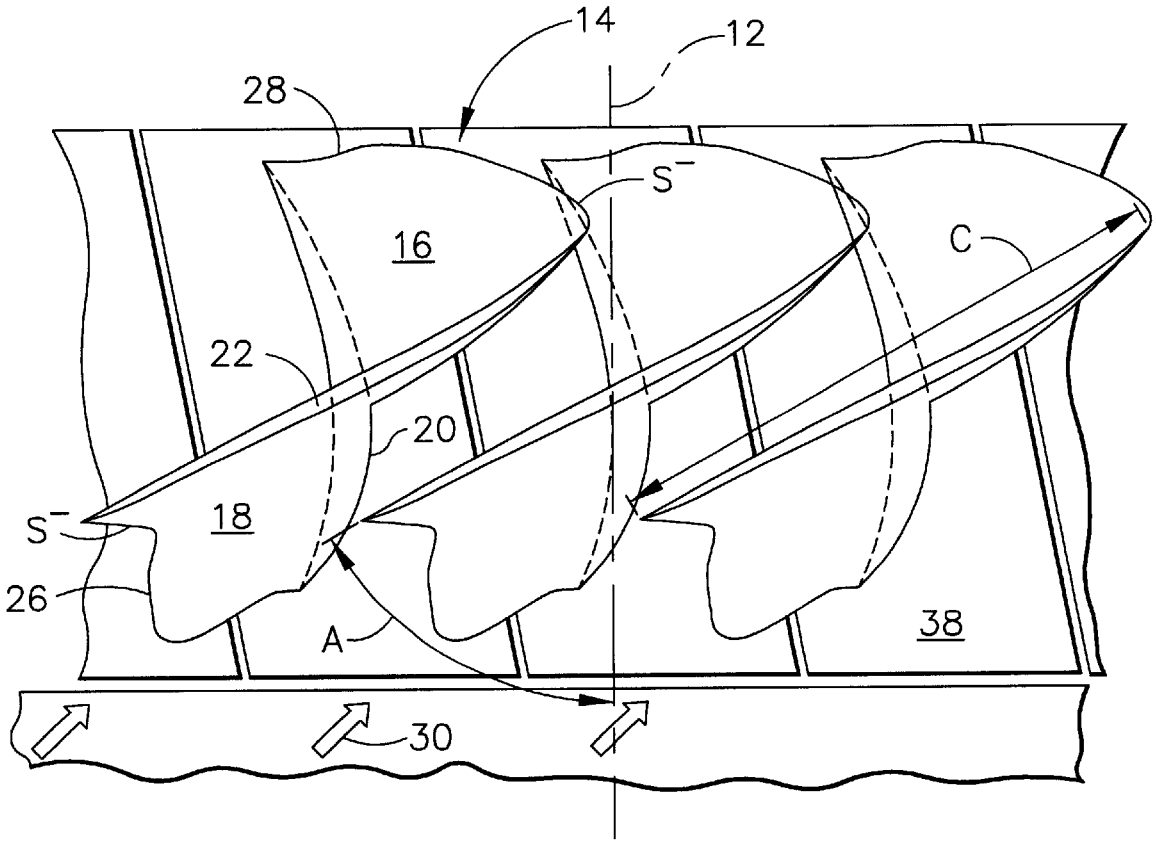
FIG. 3 is a top planiform view of the fan blades illustrated in FIG. 2 and taken along line 3—3.

The fan includes a row of circumferentially spaced apart airfoils 14 in the exemplary form of fan rotor blades as illustrated in FIGS. 1–3. As initially shown in FIG. 3, each of the airfoils 14 includes a generally concave, pressure side 16 and a circumferentially opposite, generally convex, suction side 18 extending longitudinally or radially in span along transverse or radial sections from a radially inner root 20 to a radially outer tip 22.

As shown in FIG. 1, each airfoil 14 extends radially outwardly along a radial axis 24 along which the varying radial or transverse sections of the airfoil may be defined. Each airfoil also includes axially or chordally spaced apart leading and trailing edges 26,28 between which the pressure and suction sides extend axially.

As shown in FIG. 3, each radial or transverse section of the airfoil has a chord represented by its length C measured between the leading and trailing edges. The airfoil twists from root to tip for cooperating with the air 30 channeled thereover during operation. The section chords vary in twist angle A from root to tip in a conventional manner.

As shown in FIGS. 1 and 3, the section chords of the airfoil increase in length outboard from the root 20 outwardly toward the tip 22 to barrel the airfoil above the root. In accordance with a preferred embodiment of the present invention, the chord barreling is effected along the airfoil leading edge 26 for extending in axial projection the leading edge upstream or forward of a straight line extending between the root and tip at the leading edge.

The airfoil or chord barrel has a maximum extent between the leading and trailing edges 26,28 in axial or side projection of the pressure and suction sides, as best illustrated in FIG. 1. The maximum barreling occurs at an intermediate transverse section 32 at a suitable radial position along the span of the airfoil, which in the exemplary embodiment illustrated is just below the mid-span or pitch section of the airfoil.

Preferably, the leading edge 26 in the barrel extends axially forward of the root 20, and the trailing edge 28 is correspondingly barreled and extends axially aft from the root 20. In this way, the airfoil barreling is effected along both the leading and trailing edges 26,28 in side projection.

In accordance with another feature of the present invention as illustrated in FIG. 1, the airfoil includes forward, or negative, aerodynamic sweep at its tip 22, as well as aft, or positive, aerodynamic sweep inboard therefrom. Aerodynamic sweep is a conventional parameter represented by a local sweep angle which is a function of the direction of the incoming air and the orientation of the airfoil surface in both the axial, and circumferential or tangential directions. The sweep angle is defined in detail in the above referenced U.S. Pat. No. 5,167,489, and is incorporated herein by reference. The aerodynamic sweep angle is represented by the upper case letter S illustrated in FIG. 1, for example, and has a negative value (−) for forward sweep, and a positive value (+) for aft sweep.

As shown in FIG. 1, the airfoil tip 22 preferably has forward sweep ($S^-$) at both the leading and trailing edges at the tip 22.

Both the preferred chord barreling and sweep of the fan airfoils may be obtained in a conventional manner by radially stacking the individual transverse sections of the airfoil along a stacking axis which varies correspondingly from a straight radial axis either axially, circumferentially, or both, with a corresponding non-linear curvature. Furthermore, the airfoil is additionally defined by the radial distribution of the chords at each of the transverse sections including the chord length C and the twist angle A.

Chord barreling of the airfoil in conjunction with the forward tip sweep has significant benefits. A major benefit is the increase in effective area of the leading edge of the airfoil which correspondingly lowers the average leading edge relative Mach number. Furthermore, the compression process effected by the airfoil initiates or begins at a more upstream location relative to that of an airfoil without leading edge barreling. Accordingly, the airfoil is effective for increasing its flow capacity at high or maximum speed, while also improving part speed efficiency and stability margin.

These advantages are particularly important for the airfoil 14 in the form of the fan rotor blade as it rotates. However, corresponding advantages may be obtained in fan or compressor stator vanes which do not rotate. In the blade embodiment illustrated in FIG. 1, an integral dovetail 34 conventionally mounts the airfoil to a supporting rotor disk or hub 36, and discrete platforms 38 are mounted between adjacent airfoils at the corresponding roots thereof to define the radially inner flowpath boundary for the air 30. An outer casing 40 surrounds the row of blades and defines the radially outer flowpath boundary for the air.

For the rotor blade configuration of the airfoil illustrated in FIGS. 1–3, the section chords C preferably increase in length from the root 20 all the way to the tip 22, which has a maximum chord length. Barreling of the airfoil is thusly effected by both the radial chord distribution and the varying twist angles illustrated in FIG. 3 for effecting the preferred axial projection or side view illustrated in FIG. 1.

As shown schematically in FIG. 1, the tip forward sweep of the airfoil is effected preferably at the trailing edge 28, as well as at the leading edge 26. Forward sweep of the airfoil tip is desired to maintain part speed compression efficiency and throttle stability margin. Forward sweep of the trailing edge at the tip is most effective for ensuring that radially outwardly migrating air will exit the trailing edge before migrating to the airfoil tip and reduce tip boundary layer air and shock losses therein during operation. Airflow at the airfoil tips also experiences a lower static pressure rise for a given rotor average static pressure rise than that found in conventional blades.

Forward sweep of the airfoil leading edge at the tip is also desirable for promoting flow stability. And, preferably, the forward sweep at the trailing edge 28 near the airfoil tip is greater than the forward sweep at the leading edge 26 near the tip.

The forward sweep at the trailing edge 28 illustrated in FIG. 1 preferably decreases from the tip to the root, with a maximum value at the tip and decreasing in value to the maximum chord barrel at the intermediate section 32. The trailing edge 28 should include forward sweep as far down the span toward the root 20 as permitted by mechanical constraint, such as acceptable centrifugal stress during operation. In the exemplary embodiment illustrated in FIG. 1, the trailing edge 28 includes aft sweep radially inboard of the maximum barrel which transitions to the forward sweep radially outboard therefrom.

Since airfoil barreling is effected in combination with the desired forward tip sweep of the airfoil, the leading edge 26 illustrated in FIG. 1 has forward sweep which transitions from the tip 22 to aft sweep between the tip and the maximum barrel at the intermediate section 32. The leading edge aft sweep then transitions to forward sweep inboard of the maximum barrel at the intermediate section 32. The inboard forward sweep of the leading edge may continue down to the root 20.

However, in accordance with a preferred embodiment, the leading edge 26 again transitions from forward to aft sweep outboard of the root 20 and inboard of the maximum barrel at the intermediate section 32. In this way, the airfoil leading edge combines both chord barreling and forward tip sweep to significantly improve aerodynamic performance at both part-speed and full-speed.

Three dimensional computational analysis has predicted that the forward swept, barreled airfoil 14 disclosed above has leading edge effective areas up to about one percent larger than conventional radially stacked fan blades. This corresponds to a one percent increase in flow capacity at the same or greater levels of compression efficiency.

Furthermore, part-speed or cruise efficiencies in the order of about 0.8 percent greater than conventional blades may also be achieved. A significant portion of the part-speed efficiency benefit is attributable to the forward tip sweep which reduces tip losses, and the aft sweep in the intermediate span of the blade due to chord barreling which results in lower shock strength and correspondingly reduced shock losses.

The modification of a fan blade for increasing effective frontal area through non-radial stacking of the transverse sections and chord barreling, along with the local use of forward sweep at the blade tips has advantages not only for fan blades, but may be applied to transonic fan stator vanes as well for improving flow capacity and reducing aerodynamic losses.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. An airfoil comprising:

pressure and suction sides extending in span along transverse sections from root to tip and in section chords between leading and trailing edges with said chords increasing in length outboard from said root to barrel said airfoil therefrom; and said airfoil including forward aerodynamic sweep at said tip and aft aerodynamic sweep inboard therefrom.

2. An airfoil according to claim 1 wherein said tip forward sweep is effected at said trailing edge.

3. An airfoil according to claim 2 wherein said tip forward sweep is effected at said leading edge.

4. An airfoil according to claim 3 wherein said section chords vary in twist angle between said root and tip, and said barrel has a maximum extent between said leading and trailing edges in axial projection of said sides.

5. An airfoil according to claim 4 wherein said leading edge in said barrel extends axially forward of said root, and said trailing edge in said barrel extends axially aft of said root.

6. An airfoil according to claim 5 wherein said chords increase in length from said root to said tip.

7. An airfoil according to claim 5 wherein said forward sweep at said trailing edge is greater than said forward sweep at said leading edge.

8. An airfoil according to claim 5 wherein said forward sweep at said trailing edge decreases from said tip to said maximum barrel.

9. An airfoil according to claim 8 wherein said trailing edge includes aft sweep inboard of said maximum barrel.

10. An airfoil according to claim 5 wherein said forward sweep at said leading edge transitions to aft sweep between said tip and said maximum barrel.

11. An airfoil according to claim 10 wherein said leading edge aft sweep transitions to forward sweep inboard of said maximum barrel.

12. An airfoil according to claim 11 wherein said leading edge includes aft sweep outboard of said root and inboard of said maximum barrel.

13. An airfoil according to claim 5 in the form of a fan rotor blade.

14. An airfoil having a leading edge chord barrel between a root and tip, greater chord length at said barrel than said root, and forward aerodynamic sweep at said tip.

15. An airfoil according to claim 14 further comprising pressure and suction sides extending axially between leading and trailing edges and having chords therebetween at corresponding sections of said airfoil from said root to said tip, with said chords varying in twist angle therebetween, and said barrel has a maximum extent in axial projection of said sides.

16. An airfoil according to claim 15 wherein said tip forward sweep is effected at both said leading and trailing edges.

17. An airfoil according to claim 16 wherein said leading edge in said barrel extends axially forward of said root, and said trailing edge in said barrel extends axially aft of said root.

18. An airfoil according to claim 17 wherein said forward sweep at said trailing edge is greater than said forward sweep at said leading edge.

19. An airfoil according to claim 18 wherein said forward sweep at said trailing edge decreases from said tip to said root.

20. An airfoil according to claim 19 wherein said forward sweep at said leading edge transitions from said tip to aft and forward sweep in turn inboard from said maximum barrel.

* * * * *